US011584123B2

(12) United States Patent
Takahashi et al.

(10) Patent No.: US 11,584,123 B2
(45) Date of Patent: Feb. 21, 2023

(54) INFORMATION PROCESSING APPARATUS AND COMPUTER READABLE MEDIUM

(71) Applicant: FUJIFILM Business Innovation Corp., Tokyo (JP)

(72) Inventors: Ryosuke Takahashi, Kanagawa (JP); Yasuhiro Otsuka, Yokohama (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 256 days.

(21) Appl. No.: 17/002,212

(22) Filed: Aug. 25, 2020

(65) Prior Publication Data

US 2021/0245497 A1 Aug. 12, 2021

(30) Foreign Application Priority Data

Feb. 12, 2020 (JP) ..... JP2020-021566

(51) Int. Cl.
*B41J 2/045* (2006.01)

(52) U.S. Cl.
CPC ..... *B41J 2/0456* (2013.01); *B41J 2/04586* (2013.01)

(58) Field of Classification Search
CPC .. B41J 2/04508; B41J 2/0456; B41J 2/04586; B41J 2/12
See application file for complete search history.

(56) References Cited

U.S. PATENT DOCUMENTS 6,585,340 B1 * 7/2003 Borrell ..... H04N 1/6033 358/1.9
9,028,030 B2 * 5/2015 Takekoshi ..... B41J 2/2132 347/15

FOREIGN PATENT DOCUMENTS

JP 4720274 4/2011

OTHER PUBLICATIONS

English language machine translation of JP 4720274.

* cited by examiner

*Primary Examiner* — Thinh H Nguyen
(74) *Attorney, Agent, or Firm* — Fildes & Outland, P.C.

(57) ABSTRACT

An information processing apparatus includes a processor configured to: acquire physical property information on physical properties of a recording medium and on physical properties of an ink to be ejected onto the recording medium and setting information on a setting of a device configured to eject the ink onto the recording medium, the ink including a first ink and a second ink, derive an action amount using the physical property information and the setting information, the action amount relating to an action of the second ink ejected at a position different from a position where the first ink is ejected, the second ink ejected being acted upon by behavior of the first ink, and output the action amount.

17 Claims, 7 Drawing Sheets

INFORMATION PROCESSING APPARATUS AND COMPUTER READABLE MEDIUM

CROSS-REFERENCE TO RELATED APPLICATIONS

This application is based on and claims priority under 35 USC 119 from Japanese Patent Application No. 2020-21566 filed on Feb. 12, 2020.

BACKGROUND

Technical Field

The present disclosure relates to an information processing apparatus and a computer readable medium.

Related Art

Japanese Patent No. 4720274 discloses an apparatus for simulating a shape of ink dots formed on a print medium at a time of printing a printed image, the apparatus including: a peripheral duty indicating a total amount of ink of ink dots to be formed in a peripheral area set around a pixel of interest; a reference data storage unit that stores dot shape data indicating a relationship with a spread shape of ink dots to be formed in the pixel of interest; a dot data generation unit that generates dot data indicating a formation state of the ink dots of each pixel on the print medium; a dot shape calculation unit that calculates the spread shape of each ink dot to be formed on the print medium according to the dot data by referring to the dot shape data; and an image quality evaluation index calculation unit that calculates an image quality evaluation index for evaluating an image quality of the print based on the spread shape of each ink dot calculated by the dot shape calculation unit.

SUMMARY

In an ink jet recording type image forming apparatus, there is a technique of evaluating an image to be formed on a recording medium by simulating a behavior of an ink that wets the recording medium and spreads on the recording medium when the ink is ejected onto the recording medium.

However, the number of ink droplets ejected onto the recording medium is enormous, and enormous calculation processing is required to simulate a behavior of each ink for an entire region to be printed. Since the behavior of the ink changes according to a setting (hereinafter referred to as "setting information") of the image forming apparatus at a time of printing that is related to the recording medium, the ink, and the like, it takes a lot of time to reflect the setting information and simulate the accurate behavior of the ink.

Aspects of non-limiting embodiments of the present disclosure relate to an information processing apparatus and a computer readable medium storing a program with which processing time for deriving information on a quality of an image to be formed on a recording medium may be reduced, as compared with a case of simulating a behavior of each ink for an entire region to be printed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an information processing apparatus including a processor configured to: acquire physical property information on physical properties of a recording medium and on physical properties of an ink to be ejected onto the recording medium and setting information on a setting of a device configured to eject the ink onto the recording medium, the ink including a first ink and a second ink, derive an action amount using the physical property information and the setting information, the action amount relating to an action of the second ink ejected at a position different from a position where the first ink is ejected, the second ink ejected being acted upon by behavior of the first ink, and output the action amount.

BRIEF DESCRIPTION OF DRAWINGS

Exemplary embodiment(s) of the present invention will be described in detail based on the following figures, wherein.

DETAILED DESCRIPTION

An exemplary embodiment of the present disclosure will be described in detail below with reference to the drawings. An information processing apparatus 10 according to the present exemplary embodiment is, for example, a server configured to acquire a setting value from an image forming apparatus and to evaluate an image to be formed using acquired information. However, the present invention is not limited thereto. The information processing apparatus 10 may be, for example, a terminal such as a personal computer and a tablet, or an image forming apparatus.

Figure 1:
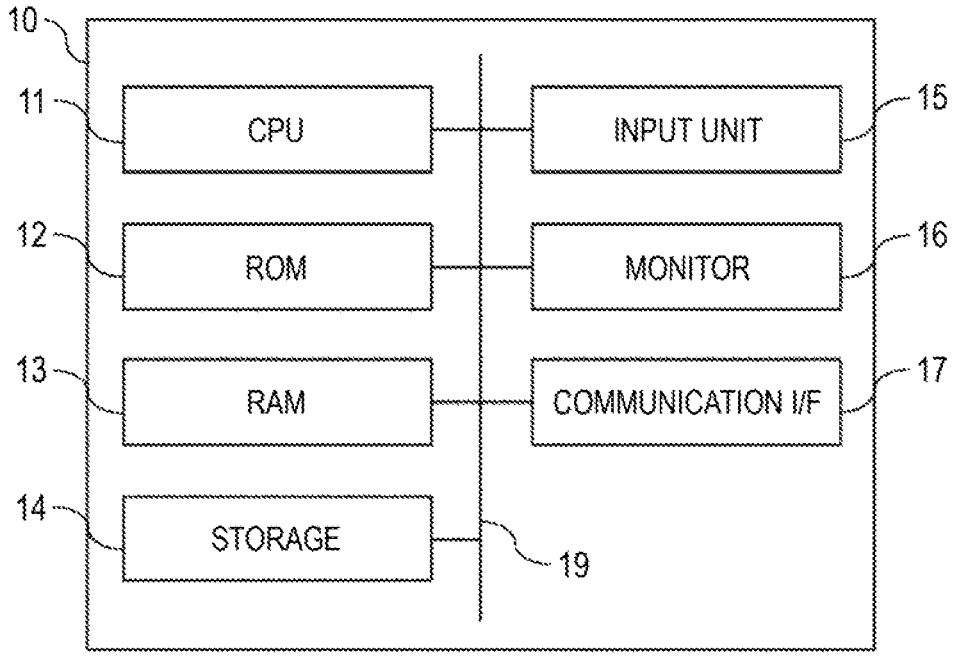
FIG. 1 is a block diagram showing an example of a hardware configuration of an information processing apparatus according to an exemplary embodiment.

A hardware configuration of the information processing apparatus 10 will be described with reference to FIG. 1. FIG. 1 is a block diagram showing an example of the hardware configuration of the information processing apparatus 10 according to the present exemplary embodiment. As shown in FIG. 1, the information processing apparatus 10 according to the present exemplary embodiment includes a central processing unit (CPU) 11, a read only memory (ROM) 12, a random access memory (RAM) 13, a storage 14, an input unit 15, a monitor 16, and a communication interface (communication I/F) 17. The CPU 11, the ROM 12, the RAM 13, the storage 14, the input unit 15, the monitor 16, and the communication I/F 17 are connected to one another by a bus 19. Here, the CPU 11 is an example of a processor.

The CPU 11 is configured to control the entire information processing apparatus 10. The ROM 12 is configured to store various programs and data including an information processing program used in the present exemplary embodiment. The RAM 13 is a memory used as a work area when the various programs are executed. The CPU 11 is configured to execute information processing by loading the program stored in the ROM 12 into the RAM 13 and executing the program. The storage 14 is, for example, a hard disk drive (HDD), a solid state drive (SSD), a flash memory, or the like. The storage 14 may store information related to the information processing program and various data acquired from the image forming apparatus. The input unit 15 is a mouse and a keyboard that are configured to input characters and the like. The monitor 16 is configured to display image data, characters, and the like. The communication I/F 17 is configured to transmit and receive data.

Figure 2:
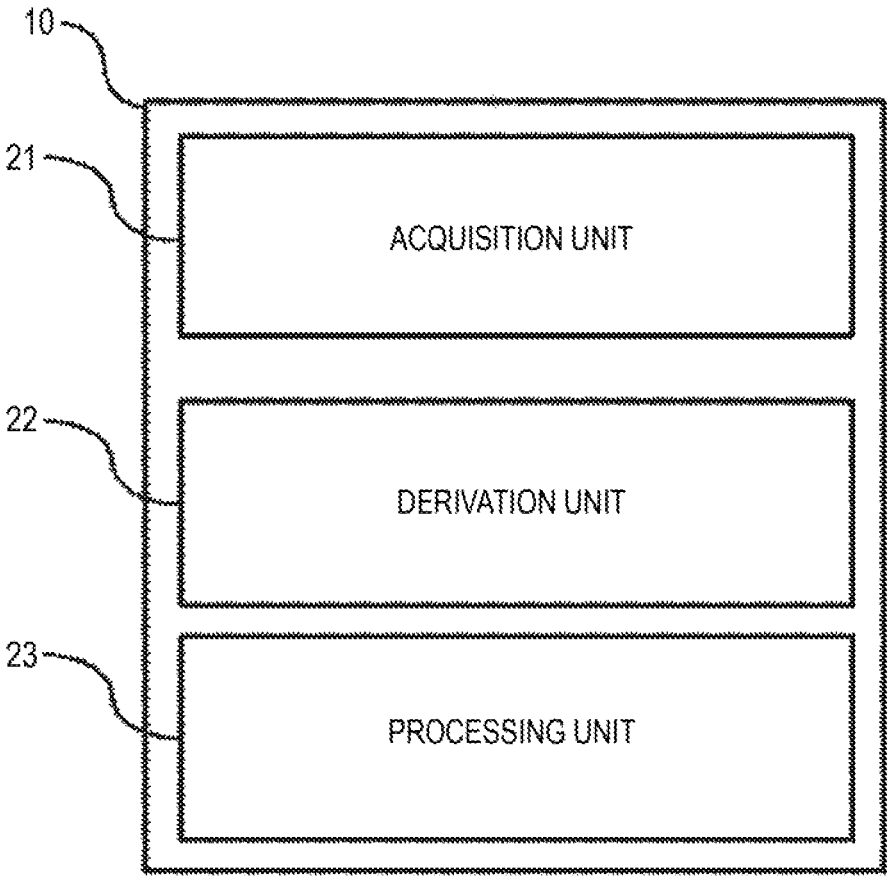
FIG. 2 is a block diagram showing an example of a functional configuration of the information processing apparatus according to the present exemplary embodiment.

Next, a functional configuration of the information processing apparatus 10 will be described with reference to FIG. 2. FIG. 2 is a block diagram showing an example of the functional configuration of the information processing apparatus 10 according to the present exemplary embodiment.

As shown in FIG. 2, the information processing apparatus 10 includes an acquisition unit 21, a derivation unit 22, and a processing unit 23. The CPU 11 executes the information processing program to function as the acquisition unit 21, the derivation unit 22, and the processing unit 23.

The acquisition unit 21 is configured to acquire information (hereinafter referred to as "physical property information") on physical properties of a recording medium and physical properties of an ink to be ejected onto the recording medium and information (hereinafter referred to as "setting information") on a setting of the image forming apparatus that ejects the ink onto the recording medium. Here, the physical properties of the recording medium acquired by the acquisition unit 21 are, for example, surface tension, an average pore diameter, and surface uneven shape distribution of the recording medium, and the physical properties of the ink are surface tension and viscosity of the ink. The setting of the image forming apparatus is a volume of the ink to be ejected, a distance between nozzles, a printing speed, a distance between heads, and a ratio (hereinafter referred to as "image density") of a region where the ink is ejected to the recording medium. A mode will be described in which the image density according to the present exemplary embodiment is a ratio of the number of ejected inks to the number of pixels of the recording medium. However, the present invention is not limited thereto. The image density may be a total area of the ejected inks with respect to an area of the recording medium.

The derivation unit 22 derives, using the physical property information and the setting information, an action amount relating to operation of a second drop of the ink applied by a behavior of a first drop of the ink in the second drop of the ink ejected at a position different from that of the first drop of the ink. Here, the first drop of the ink is an example of a first ink, and the second drop of the ink is an example of a second ink.

Specifically, the derivation unit 22 derives a movement amount of the second drop of the ink as the action amount. For example, a gap generated by plural first drops of the ink causes a capillary force to act on the second drop of the ink, and the second drop of the ink moves from the ejected position. The derivation unit 22 derives the movement amount of the second drop of the ink.

In the present exemplary embodiment, a mode has been described in which the gap of the plural the first drops of the ink causes the capillary force to act on the second drop of the inks. However, the present invention is not limited thereto. For example, an intermolecular force may act on the first drop of the ink and the second drop of the ink.

The derivation unit 22 derives a width of a gap of the inks using the wetting and spreading width of the ink, and derives the movement amount of the second drop of the ink using the width of the gap of the first drops of the ink.

The derivation unit 22 derives a remaining amount of the second drop of the ink present on the recording medium using at least one of the wetting and spreading width, the image density, and a permeation amount, and derives the movement amount of the second drop of the ink using the remaining amount of the second drop of the ink.

The processing unit 23 is configured to output the derived action amount, and to evaluate a quality of an image to be formed on the recording medium using the action amount. Specifically, when the action amount exceeds a predetermined threshold value, the processing unit 23 notifies a fact that a quality of the image is poor, or notifies the setting information (for example, the printing speed and the image density) to set the action amount to be smaller than the predetermined threshold value.

A mode has described in which the processing unit 23 according to the present exemplary embodiment performs the notification when the action amount exceeds the predetermined threshold value. However, the present invention is not limited thereto. When the action amount exceeds the threshold value, the processing unit 23 may change the setting information to correct the action amount to the threshold value or smaller. Specifically, the processing unit 23 may correct at least one of the printing speed and the image density included in the setting information to correct the action amount to the threshold value or smaller. The threshold value according to the present exemplary embodiment is not particularly limited. For example, a predetermined value may be set as the threshold value, or magnitude corresponding to any percentage of the wetting and spreading width of the ink may be set as the threshold value. A mode has been described in which the threshold value according to the present exemplary embodiment is compared with magnitude of the action amount (the movement amount). However, the present invention is not limited thereto. The threshold may be a ratio. For example, a ratio of the action amount (the movement amount) to the wetting and spreading width of the ink may be derived and compared with the threshold value.

Next, a method of deriving the action amount according to the present exemplary embodiment will be described with reference to FIGS. 3 to 7 before operation of the information processing apparatus 10 is described.

Figure 3:
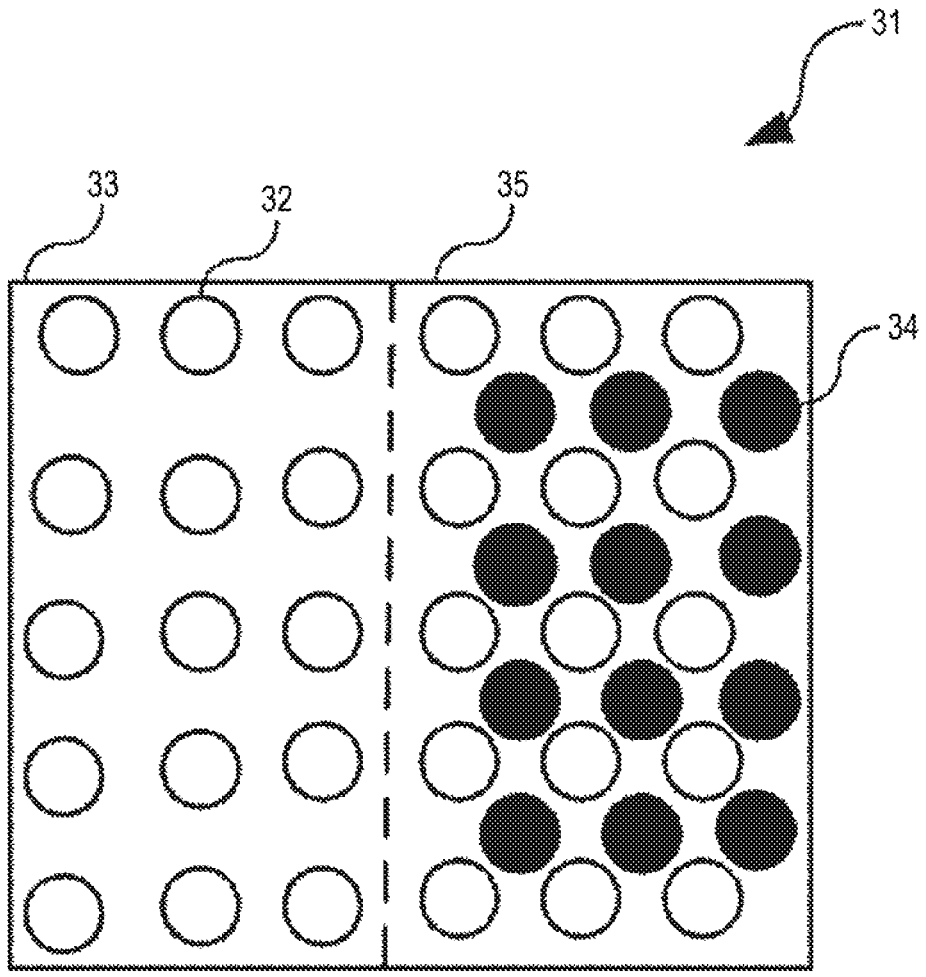
FIG. 3 is a schematic view illustrating an example of a recording medium on which an ink is ejected according to the present exemplary embodiment.

First, the action amount of the ink ejected onto the recording medium will be described with reference to FIG. 3. FIG. 3 is a schematic view illustrating an example of the recording medium on which the ink is ejected according to the present exemplary embodiment.

As an example, as illustrated in FIG. 3, the recording medium 31 includes a region 33 to which only a first drop of an ink 32 has been ejected, and a region 35 to which the first drop of the ink 32 and a second drop of an ink 34 have been ejected. In the present exemplary embodiment, a mode will be described in which a gap of the plural the first drops of the ink 32 ejected to the region 35 causes a capillary force to act on the second drop of the ink 34 and a movement amount of the movement of the second drop of the ink to the region 33 is derived.

Figure 4:
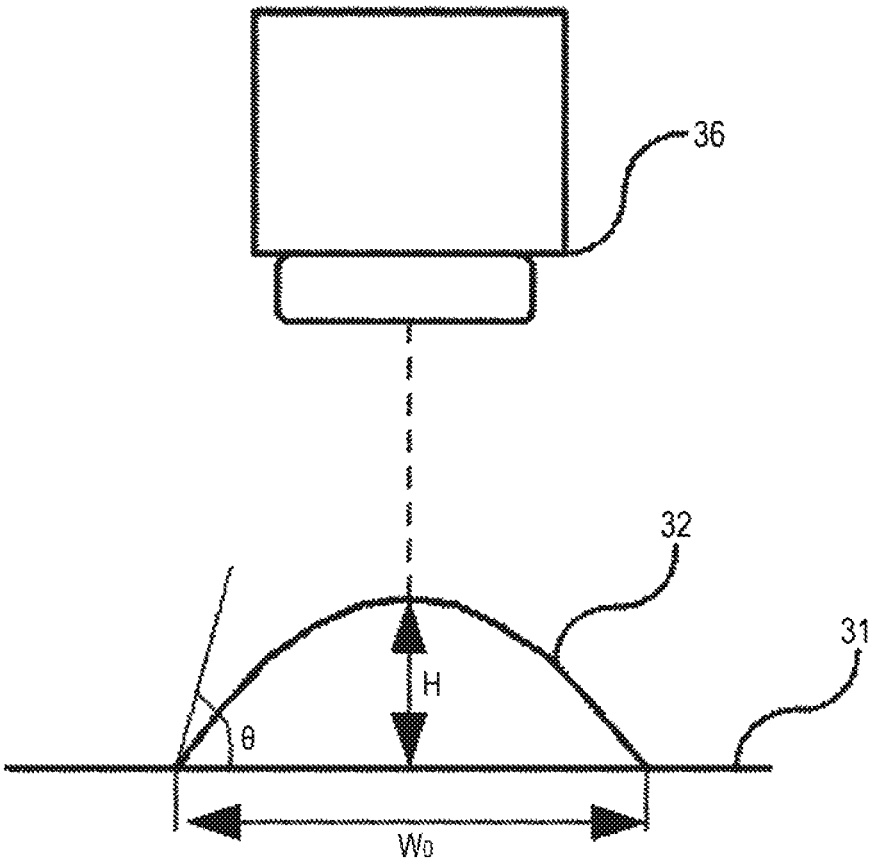
FIG. 4 is a schematic view illustrating an example of the ink ejected onto the recording medium according to the present exemplary embodiment.

Next, the ink 32 ejected onto the recording medium will be described with reference to FIG. 4. FIG. 4 is a schematic view illustrating an example of the ink 32 ejected onto the recording medium 31 according to the present exemplary embodiment.

As illustrated in FIG. 4, when the first drop of the ink 32 ejected from a nozzle 36 of the image forming apparatus comes into contact with the recording medium 31, a droplet is formed on the recording medium 31.

The information processing apparatus 10 acquires physical property information (an average pore diameter and surface uneven shape distribution of the recording medium 31, viscosity of the ink 32, surface tension, and the like). Here, the surface tension includes surface tension of the recording medium 31, surface tension of the ink 32, and surface tension between the recording medium 31 and the ink 32. A mode has been described in which the information processing apparatus 10 according to the present exemplary embodiment acquires the average pore diameter and the surface uneven shape distribution of the recording medium 31, the viscosity of the ink, and the surface tension as the physical property information. However, the present invention is not limited thereto. The information processing apparatus 10 may acquire information on physical properties which are an electrical resistance value, electrical conductivity, electrical polarizability, and the like of the recording medium 31 and the ink 32 as the physical property information.

The information processing apparatus 10 acquires the setting information (a volume of the ink, a distance between nozzles, a printing speed, a distance between heads, and an image density) of the image forming apparatus. The volume of the ink according to the present exemplary embodiment is constant, and the printing speed is a speed at which the ink is ejected from the ejection of the first drop of the ink to the ejection of the second drop of the ink.

The information processing apparatus 10 derives, using the acquired physical property information, the contact angle of the recording medium 31 illustrated in FIG. 4 and a permeation coefficient when the ink 32 permeates the recording medium 31. The contact angle and the permeation coefficient are expressed by the following equations.

$$\cos\theta = \frac{\sigma_s - \sigma_{fs}}{\sigma_f} \tag{1}$$

$$\beta = \sqrt{\frac{r\sigma_f \cos\theta}{2\mu}} \tag{2}$$

Here, θ is the contact angle of the ink 32 in contact with the recording medium 31, am is the surface tension of the recording medium 31, or is the surface tension of the ink 32, and $\sigma_{fs}$ is the surface tension between the recording medium 31 and the ink 32. β is the permeation coefficient, τ is the average pore diameter of the recording medium 31, and μ is the viscosity of the ink 32.

As illustrated in FIG. 4, the wetting and spreading width of the ink 32 formed on the recording medium 31 is expressed by the following equations.

$$\tan\theta = \frac{2H}{W_0} \tag{3}$$

-continued $$V_0 = \frac{\pi}{6}H\left\{3\left(\frac{W_0}{2}\right)^2 + H^2\right\} \tag{4}$$

Here, H is a height of a vertex of the ink 32, and $V_0$ is the volume of the ink 32.

That is, using Equations (1), (3), and (4), the wetting and spreading width $W_0$ of the ink 32 is expressed using the volume $V_0$ and surface tension of the ink 32. That is, the wetting and spreading width We is derived using the acquired physical property information.

Figure 5:
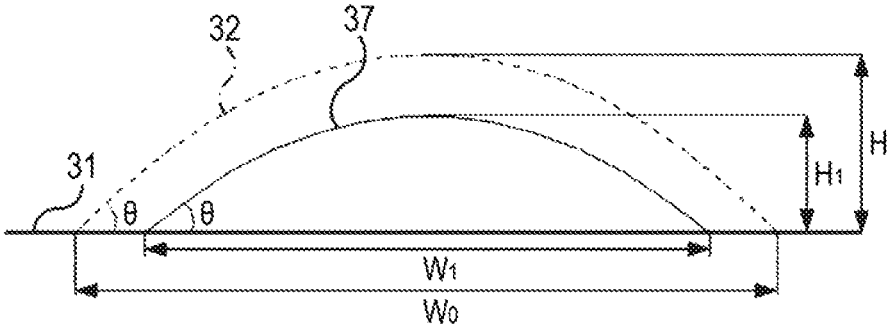
FIG. 5 is a schematic diagram showing an example of the ejected ink for describing a wetting and spreading width according to the present exemplary embodiment.

Next, a method of deriving the wetting and spreading width of the ink when any time has elapsed will be described with reference to FIG. 5. FIG. 5 is a schematic diagram showing an example of the ejected ink for describing the wetting and spreading width according to the present exemplary embodiment.

As shown in FIG. 5, when any time has elapsed, the ink 32 ejected onto the recording medium 31 permeates the recording medium 31. An ink 37 having a reduced volume is present on the recording medium 31, and a wetting and spreading width of the ink 37 decreases as the volume decreases. The wetting and spreading width of the ink 37 remaining on the recording medium 31 is derived using the following equations.

$$t_1 = \frac{d_h}{v} \tag{5}$$

$$\Delta V = \frac{\pi}{4}\beta\sqrt{t_1}\,W_0^2 \tag{6}$$

$$V_1 = V_0 - \Delta V \tag{7}$$

$$\tan\theta = \frac{2H_1}{W_1} \tag{8}$$

$$V_1 = \frac{\pi}{6}H_1\left\{3\left(\frac{W_1}{2}\right)^2 + H_1^2\right\} \tag{9}$$

Here, $t_1$ is the time from the ejection of the first drop of the ink to the ejection of the second drop of the ink, v is a printing speed at which the second drop of the ink is ejected after the first drop of the ink is ejected, and $d_h$ is a distance between the heads of the image forming apparatus. ΔV is the amount of the ink permeating the recording medium 31 when the time from the ejection of the first drop of the ink 32 to the ejection of the second drop of the ink 34 from the surface where the ink 32 is in contact with the recording medium. $V_1$ is the volume of the ink 37 remaining on the recording medium 31 when the time from the ejection of the first drop of the ink to the ejection of the second drop of the ink has elapsed. Hi is a height of a vertex of the ink 37, and $W_1$ is the wetting and spreading width of the ink 37.

Equation (5) described above is derived from the acquired printing speed v and distance between the heads in the setting information, and the amount ΔV of the volume of the ink 32 in contact with the recording medium 31 which permeates the recording medium 31 is indicated by Equation (6) described above and is derived using Equations (2) and (5) described above.

As indicated by Equation (7), when the amount ΔV of the volume of the ink which permeates the recording medium 31 is subtracted from the volume $V_0$ of the ink 32 immediately after being ejected onto the recording medium 31, the volume $V_1$ of the ink 37 remaining on the recording medium 31 is derived.

The wetting and spreading width $W_1$ of the ink 37 remaining on the recording medium 31 when the time from the ejection of the first drop of the ink 32 to the ejection of the second drop of the ink 34 has elapsed is derived from Equations (8) and (9), and the derived volume $V_1$. Therefore, the wetting and spreading width $W_1$ of the ink 37 remaining on the recording medium 31 is derived using the setting information and the physical property information.

Figure 6:
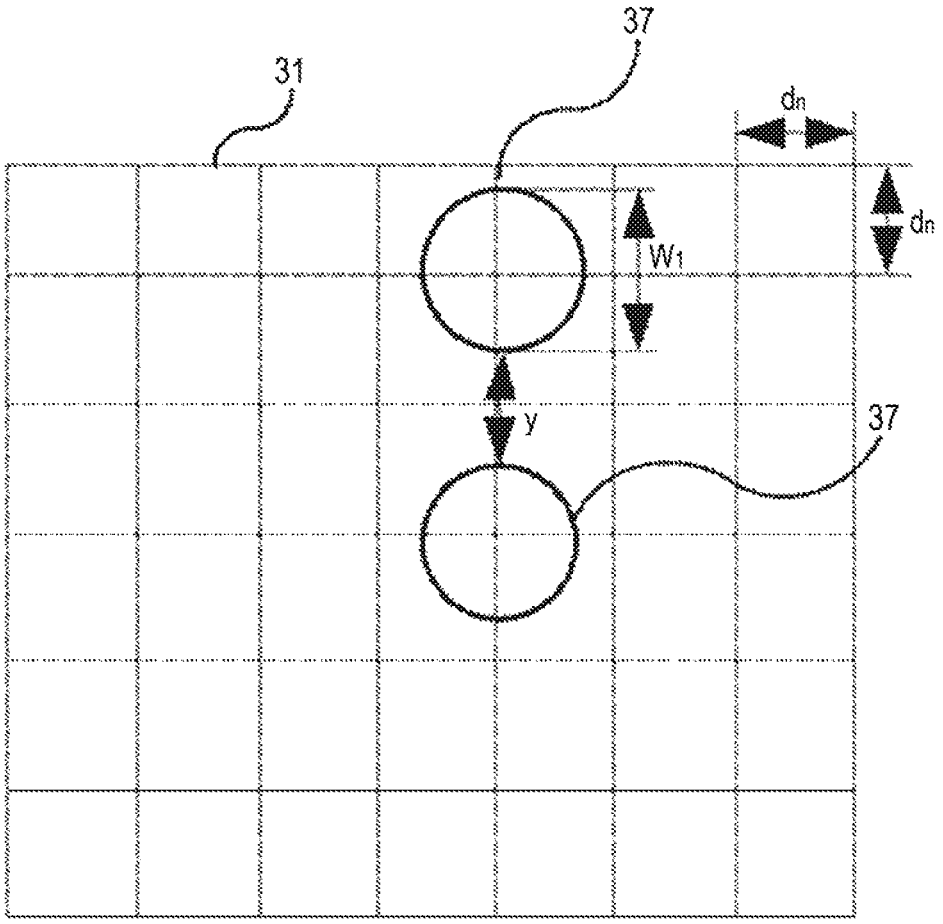
FIG. 6 is a schematic diagram showing an example of the recording medium on which the inks have been ejected for describing deriving of the wetting and spreading widths of the inks and a distance between the inks when any time has elapsed according to the present exemplary embodiment.

Next, a method of deriving a distance between the inks will be described with reference to FIG. 6. FIG. 6 is a schematic diagram showing an example of the recording medium on which the inks have been ejected for describing deriving of the distance between the inks when any time has elapsed according to the present exemplary embodiment.

As shown in FIG. 6, a distance between the inks 37 that have the wetting and spreading width $W_1$ and remain on the recording medium 31 is expressed by the following equation.

$$y = \frac{d_n}{c_{in1}} - 2 \cdot \frac{W_1}{2} \tag{10}$$

Here, y is a width of a gap between the inks 37, $d_n$ is the distance between the nozzles of the image forming apparatus, and $C_{int}$ is the image density of the first drop of the ink.

A first item of Equation (10) is an expected value of an interval between vertex positions of the ejected inks 37, and a second item of Equation (10) represents a distance reduced due to the wetting and spreading of the inks 37. In other words. Equation (10) represents the width of the gap of the ejected inks by subtracting a distance of wetting and spreading from the interval between the vertex positions of the ejected inks.

The movement amount of the movement caused by the capillary force acting on the second drop of the ink is derived using the width y of the gap between the first drops of the ink derived out by Equation (10). The movement amount of the movement caused by the capillary force acting on the second drop of the ink is expressed by the following equation.

$$L_1 = k_1 \cdot \frac{2\sigma_f \cos\theta}{y} V_2 \cdot C_{in2} \cdot 100 \tag{11}$$

Here, $L_1$ is the movement amount of the movement caused by the capillary force acting on the second drop of the ink 34, $k_1$ is any coefficient, $V_2$ is a volume of the second drop of the ink 34 present on the recording medium, and $C_{in2}$ is an image density of the second drop of the ink 34. The movement amount according to the present exemplary embodiment is a value calculated by multiplying the movement amount per ink droplet by a density. $K_1$ is a coefficient that represents ease of the movement of the second drop of the ink 34 caused by the capillary force, and varies depending on physical properties of the ink 34. For example, even if the capillary forces are the same, if a mass (a density) of the ink 34 is different, the movement amount of the ink 34 also varies.

As indicated by Equation (11) described above, the movement amount $L_1$ of the second drop of the ink 34 is inversely proportional to the width of the gap of the inks 37, and is proportional to the volume $V_2$ of the second drop of the ink present on the recording medium 31. The volume of the second drop of the ink is expressed by the following equations.

$$S = \frac{\pi}{4} W_1^2 \tag{12}$$

$$R = \frac{s}{d_n^2} C_{in1} \cdot 100 \tag{13}$$

$$\Delta V_2 = \frac{\pi}{4} \beta \sqrt{t}\, W_0^2 \cdot \left(1 - \frac{R}{100}\right) \tag{14}$$

Here, S is an area in which the ink 37 is in contact with the recording medium when any time from the ejection of the first drop of the ink 32 to the ejection of the second drop of the ink 34 has elapsed, and R is a ratio of the ink 37 to the recording medium. $\Delta V_2$ is a volume of the second drop of the ink 34 which permeates the recording medium 31, and t is any time that has elapsed from the ejection of the second drop of the ink 34.

As indicated by Equation (14), the volume $\Delta V_2$ of the second drop of the ink that permeates the recording medium is proportional to an area of the second drop of the ink in contact with the recording medium. In the present exemplary embodiment, the permeation of the second drop of the ink does not occur at a position to which the first drop of the ink has already been ejected on the recording medium. That is, when ejected to a position to which the first drop of the ink is not ejected, the second drop of the ink 34 permeates the recording medium 31. Therefore, as indicated by Equation (14), the volume of the second drop of the ink that permeates the recording medium is derived by multiplying an amount of the permeation of the second drop of the ink by a ratio (1−R/100) of the position to which the first ink is not ejected.

Therefore, the volume $V_2$ of the second drop of the ink is derived by subtracting the volume $\Delta V_2$ of the second drop of the ink which has permeated the recording medium from the volume $V_0$ of the second drop of the ink immediately after being ejected, as indicated by Equation (15) described above.

In the present exemplary embodiment, a mode has been described in which the movement amount of the ink is simulated in consideration of the capillary force generated by the width of the gap between the first drops of the ink. However, the present invention is not limited thereto. For example, the movement amount of the ink which permeates the recording medium 31 may be simulated. Specifically, the movement amount of the second drop of the ink which has permeated the recording medium is expressed by the following equation.

$$L_2 = k_2 \cdot \Delta V_2 \cdot C_{in2} \cdot 100 \tag{16}$$

Here, $L_2$ is the movement amount of the second drop of the ink which has permeated the recording medium, and $k_2$ is any coefficient.

As indicated by Equation (16) described above, the movement amount of the second drop of the ink which has permeated the recording medium is proportional to the volume of the second drop of the ink which has permeated the recording medium and the image density of the second drop of the ink.

Using Equations (11) and (16) described above, the movement amount of the second drop of the ink according to a type of the recording medium is derived. The movement amount of the second drop of the ink according to the type of the recording medium is expressed by the following equations.

$$L=L_1+k_3 \quad (17)$$

$$L=L_1+L_2+k_4 \quad (18)$$

$$L=L_2+k_5 \quad (19)$$

Here, L is the movement amount of the second drop of the ink in consideration of the type of the recording medium, and $k_3$, $k_4$, and $k_5$ are any coefficient. $k_3$, $k_4$, and $k_5$ are coefficients indicating the ease of movement of the second drop of the ink 34 relative to the recording medium 31, and vary depending on the physical properties of the ink 34 and physical properties of the recording medium 31. For example, when the recording medium 31 is excellent in hydrophilicity, the movement amount of the second drop of the ink 34 ejected onto the recording medium 31 is larger than that in a case in which the second drop of the ink 34 is ejected onto the recording medium 31 having poor hydrophilicity.

As indicated by Equations (17), (18), and (19), in consideration of the movement amount $L_1$ of the second drop of the ink present on the recording medium 31 and the movement amount $L_2$ of the second drop of the ink which permeates the recording medium, the movement amount L of the second drop of the ink in consideration of the type of the recording medium 31 is expressed.

Specifically, Equation (17) expresses a movement amount of the ink in a case in which the ink is not likely to permeate the recording medium 31 and remains on the recording medium 31, and Equation (18) expresses a movement amount of the ink in a case of an intermediate paper in which the ink permeates the recording medium to some extent. Equation (19) expresses a movement amount of the ink in a case in which the ink does not remain on the recording medium and permeates the recording medium.

That is, when an image is evaluated, more accurate image evaluation is performed by selecting one from Equations (17), (18), and (19) described above according to the recording medium on which the image is formed.

Figure 7:
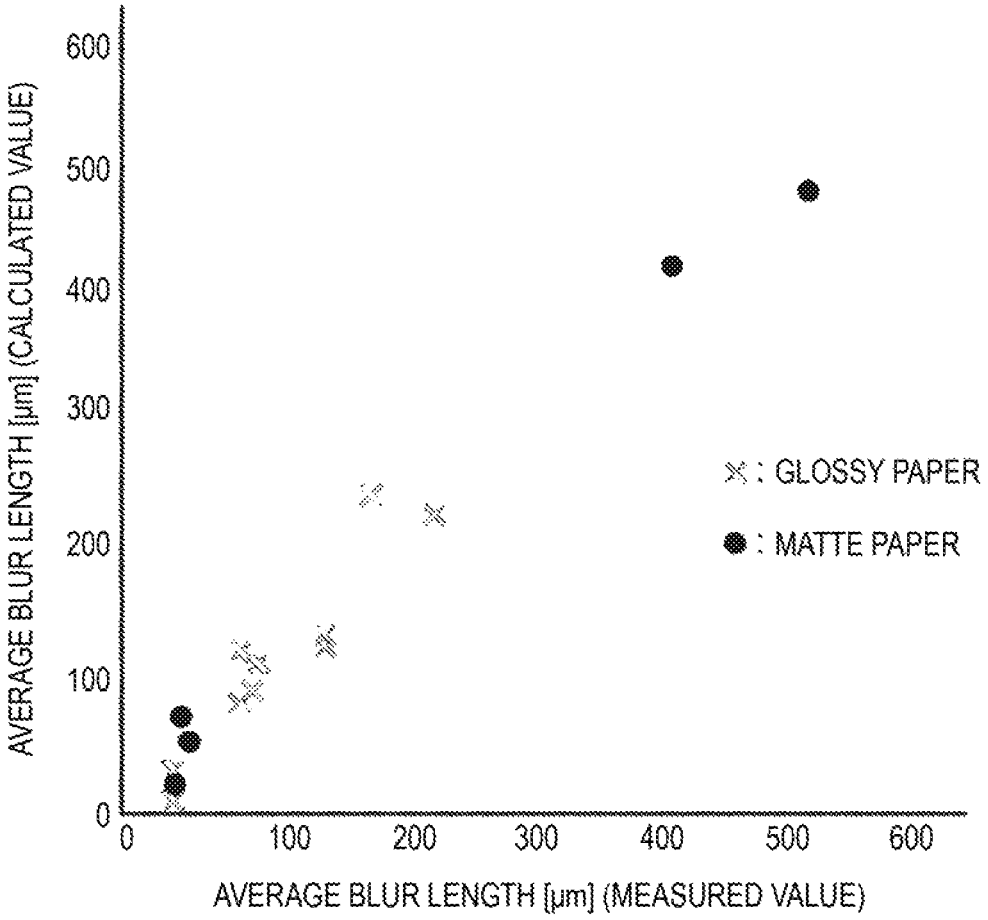
FIG. 7 is a graph showing an example of measured values and calculated values of an average blur length according to the present exemplary embodiment.

Next, with reference to FIG. 7, a comparison result between the movement amount of the ink derived by the simulation and a movement amount of the ink obtained by ejecting the ink and actually measuring the ink will be described. FIG. 7 is a graph showing an example of measured values and calculated values of an average blur length according to the present exemplary embodiment. FIG. 7 shows that there is a correlation between the measured values and the calculated values of the average blur length when a glossy paper or a matte paper is used as the recording medium 31. Here, the average blur length is an average value of the movement amount of the second drop of the ink in consideration of the type of the recording medium.

As shown in FIG. 7, it may be apparent that a difference between the calculated values of the average blur length according to the present exemplary embodiment and the measured values of the average blur length is sufficiently small. That is, FIG. 7 shows that the quality of an image to be formed on the recording medium may be evaluated statistically from the behaviors of the first and second drops of the ink. Using FIG. 7, $k_1$, $k_2$, $k_3$, $k_4$, and $k_5$ with which the calculated values of the average blur length match the measured values of the average blur length may be derived.

Figure 8:
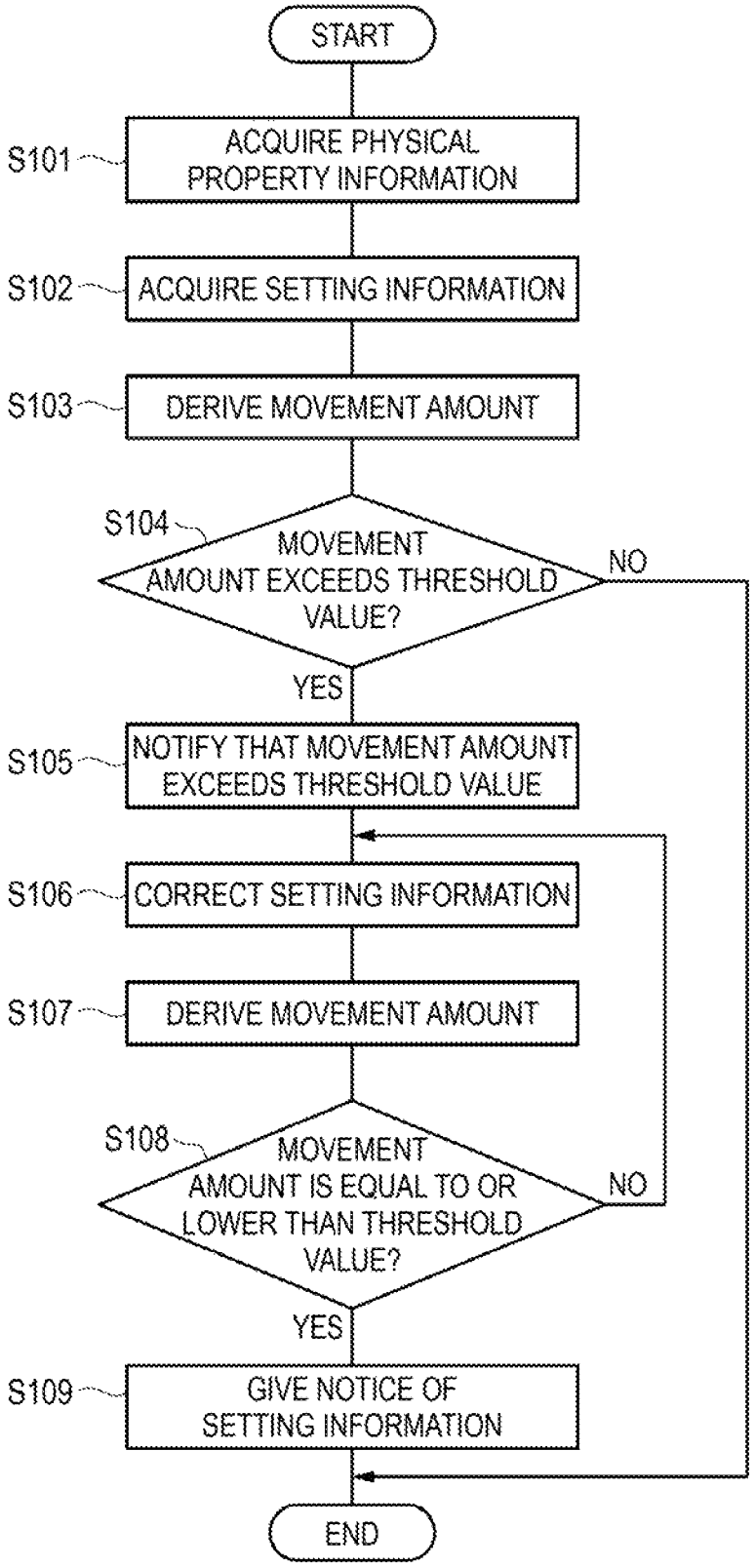
FIG. 8 is a flowchart showing an example of information processing according to the present exemplary embodiment.

Next, operation of the information processing program according to the present exemplary embodiment will be described with reference to FIG. 8. FIG. 8 is a flowchart showing an example of information processing according to the present exemplary embodiment. The CPU 11 reads the information processing program from the ROM 12 or the storage 14 and executes the information processing program to execute the information processing shown in FIG. 8. The information processing shown in FIG. 8 is executed when, for example, the user inputs an instruction to execute the information processing program.

In step S101, the CPU 11 acquires the physical property information.

In step S102, the CPU 11 acquires the setting information.

In step S103, the CPU 11 derives the movement amount.

In step S104, the CPU 11 determines whether the movement amount exceeds the threshold value. When the movement amount exceeds the threshold value (step S104: YES), the CPU 11 proceeds to step S105. On the other hand, when the movement amount does not exceed the threshold value (step S104: NO), the CPU 11 ends the processing.

In step S105, the CPU 11 notifies the user that the movement amount exceeds the threshold value and the quality of the image to be formed is poor. Here, as the notification processing, a content to be notified may be displayed on a monitor, or the content to be notified may be transmitted to a terminal of the user.

In step S106, the CPU 11 corrects a value of the setting information and performs the correction set in the setting information. As an example, the setting information to be corrected is the image density and the printing speed. One of the image density and the printing speed may be corrected, or the image density and the printing speed may be corrected. A mode has been described in which the setting information to be corrected according to the present exemplary embodiment is the image density and the printing speed. However, the present invention is not limited thereto. For example, the volume of the ink to be ejected may be corrected.

In step S107, the CPU 11 derives the movement amount using the corrected setting information.

In step S108, the CPU 11 determines whether the movement amount is the threshold value or smaller. When the movement amount is the threshold value or smaller (step S108: YES), the CPU 11 proceeds to step S109. On the other hand, when the movement amount is larger than the threshold value (step S108: NO), the CPU 11 proceeds to step S106.

In step S109, the CPU 11 notifies the user of the corrected setting information.

The information processing program according to the present exemplary embodiment has described a mode in which the user is notified of the corrected setting information. However, the present invention is not limited thereto. For example, the corrected setting information may be set as setting information at a time of actually forming an image.

As described above, using the physical property information and the setting information, the action amount indicating the operation of the second drop of the ink applied by the behavior of the first drop of the ink is derived, and information on the quality of the image is statistically derived. Therefore, according to the present exemplary embodiment, processing time for deriving the information on the quality of the image is reduced as compared with a case of simulating the behavior of each ink for an entire region to be printed.

The configuration of the information processing apparatus 10 described in the above exemplary embodiment is an example, and may be changed depending on a situation without departing from the gist of the present disclosure.

The processing flow of the program described in the above exemplary embodiment is also an example, and an unnecessary step may be deleted, a new step may be added, or the processing order may be changed without departing from the gist of the present disclosure.

In the embodiments above, the term "processor" refers to hardware in a broad sense. Examples of the processor includes general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

In the above exemplary embodiment, instead of being stored (installed) in the storage medium 14 in advance, the program PR may be provided by being recorded in a recording medium such as a compact disc read only memory (CD-ROM), a digital versatile disc read only memory (DVD-ROM), and a universal serial bus (USB) memory, or may be downloaded from an external device via a network.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A non-transitory computer readable medium storing a program causing a computer to execute a process for information processing, the process comprising:

acquiring physical property information on physical properties of a recording medium and on physical properties of an ink to be ejected onto the recording medium and setting information on a setting of a device configured to eject the ink onto the recording medium, the ink including a first ink and a second ink, deriving an action amount using the physical property information and the setting information, the action amount relating to an action of the second ink ejected at a position different from a position where the first ink is ejected, the second ink ejected being acted upon by behavior of the first ink, and outputting the action amount, wherein a movement amount of the second ink is derived, as the action amount, using a gap width of the first ink, and the gap width of the first ink is derived using a wetting and spreading width of the first ink.

2. The non-transitory computer readable medium according to claim 1, wherein the movement amount of the second ink is derived using a remaining amount of the second ink on the recording medium.

3. The non-transitory computer readable medium according to claim 2, wherein the remaining amount of the second ink is derived using at least one of the wetting and spreading width of the first ink, an image density of the first ink, and a permeation amount of the second ink.

4. The non-transitory computer readable medium according to claim 1, wherein, in a case where the action amount exceeds a predetermined threshold value, a user is notified that a quality of an image to be formed on the recording medium is poor.

5. The non-transitory computer readable medium according to claim 4, wherein, in a case where the action amount exceeds the predetermined threshold value, corrected setting information with which the action amount is equal to or smaller than the predetermined threshold value is derived, and notice of the corrected setting information is given.

6. The non-transitory computer readable medium according to claim 4, wherein, in a case where the action amount exceeds the predetermined threshold value, the setting information is corrected to achieve the action amount equal to or smaller than the predetermined threshold value.

7. The non-transitory computer readable medium according to claim 6, wherein, at least one of a printing speed and an image density included in the setting information is corrected to achieve the action amount equal to or smaller than the predetermined threshold value.

8. A non-transitory computer readable medium storing a program causing a computer to execute a process for information processing, the process comprising:

acquiring physical property information on physical properties of a recording medium and on physical properties of an ink to be ejected onto the recording medium and setting information on a setting of a device configured to eject the ink onto the recording medium, the ink including a first ink and a second ink, deriving an action amount using the physical property information and the setting information, the action amount relating to an action of the second ink ejected at a position different from a position where the first ink is ejected, the second ink ejected being acted upon by behavior of the first ink, and outputting the action amount, wherein a movement amount of the second ink is derived, as the action amount, using a remaining amount of the second ink on the recording medium.

9. The non-transitory computer readable medium according to claim 8, wherein the remaining amount of the second ink is derived using at least one of a wetting and spreading width of the first ink, an image density of the first ink, and a permeation amount of the second ink.

10. The non-transitory computer readable medium according to claim 8, wherein, in a case where the action amount exceeds a predetermined threshold value, a user is notified that a quality of an image to be formed on the recording medium is poor.

11. A non-transitory computer readable medium storing a program causing a computer to execute a process for information processing, the process comprising:

acquiring physical property information on physical properties of a recording medium and on physical properties of an ink to be ejected onto the recording medium and setting information on a setting of a device configured to eject the ink onto the recording medium, the ink including a first ink and a second ink, deriving an action amount using the physical property information and the setting information, the action amount relating to an action of the second ink ejected at a position different from a position where the first ink is ejected, the second ink ejected being acted upon by behavior of the first ink, and outputting the action amount, wherein, in a case where the action amount exceeds a predetermined threshold value, a user is notified that a quality of an image to be formed on the recording medium is poor.

12. The non-transitory computer readable medium according to claim 11, wherein, in a case where the action amount exceeds the predetermined threshold value, corrected setting information with which the action amount is equal to or smaller than the predetermined threshold value is derived, and notice of the corrected setting information is given.

13. The non-transitory computer readable medium according to claim 12, wherein, in a case where the action amount exceeds the predetermined threshold value, the setting information is corrected to achieve the action amount equal to or smaller than the predetermined threshold value.

14. The non-transitory computer readable medium according to claim 13, wherein, at least one of a printing speed and an image density included in the setting information is corrected to achieve the action amount equal to or smaller than the predetermined threshold value.

15. The non-transitory computer readable medium according to claim 11, wherein, in a case where the action amount exceeds the predetermined threshold value, corrected setting information with which the action amount is equal to or smaller than the predetermined threshold value is derived, and notice of the corrected setting information is given.

16. The non-transitory computer readable medium according to claim 11, wherein, in a case where the action amount exceeds the predetermined threshold value, the setting information is corrected to achieve the action amount equal to or smaller than the predetermined threshold value.

17. The non-transitory computer readable medium according to claim 16, wherein, at least one of a printing speed and an image density included in the setting information is corrected to achieve the action amount equal to or smaller than the predetermined threshold value.

* * * * *